US011686054B2

(12) United States Patent
Smieja et al.

(10) Patent No.: US 11,686,054 B2
(45) Date of Patent: Jun. 27, 2023

(54) TEMPERATURE CONTROLLED ROTOR SPRAY BAR

(71) Applicant: Caterpillar Paving Products Inc., Brooklyn Park, MN (US)

(72) Inventors: Jameson Michael Smieja, Mound, MN (US); Heath Daryl Wilson, Ore City, TX (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 17/450,394

(22) Filed: Oct. 8, 2021

(65) Prior Publication Data

US 2023/0111274 A1 Apr. 13, 2023

(51) Int. Cl.
*E01C 23/12* (2006.01)
*E01C 23/088* (2006.01)

(52) U.S. Cl.
CPC ..... *E01C 23/127* (2013.01); *E01C 23/088* (2013.01)

(58) Field of Classification Search
CPC ..... E01C 23/088; E01C 23/127
See application file for complete search history.

(56) References Cited

U.S. PATENT DOCUMENTS 2,924,873 A * 2/1960 Knowles ..... B23B 27/10 125/11.22
10,000,894 B1 * 6/2018 Schlenker ..... E01C 19/176
2005/0056098 A1 * 3/2005 Solie ..... G01L 19/0092 73/702
2005/0168048 A1 * 8/2005 Gaertner ..... E01C 23/088 299/1.5
2015/0104255 A1 * 4/2015 Musil ..... E01C 23/088 404/128
2017/0159432 A1 * 6/2017 Lavely ..... B28D 1/186
2017/0343418 A1 * 11/2017 Hurbi ..... G01J 5/061

FOREIGN PATENT DOCUMENTS

CN 204703766 10/2015
CN 110385469 10/2019
CN 110625440 12/2019
CN 211927094 11/2020
JP 2018054612 4/2018
WO WO-2020043529 A1 * 3/2020 ..... E01C 23/088

* cited by examiner

*Primary Examiner* — Janine M Kreck
(74) *Attorney, Agent, or Firm* — Schwegman, Lundberg & Woessner

(57) ABSTRACT

A milling machine can include a frame; a cutting rotor attached to the frame, the cutting rotor including a plurality of cutting bits positioned along a length of the cutting rotor; a plurality of temperature sensors positioned to determine a temperature proximate one or more of the plurality of cutting bits; a spray system coupled to the frame and including a spray bar having a plurality of nozzles configured to spray a cooling fluid on the cutting rotor; and a controller to receive the temperatures of the one or more cutting bits, the controller configured to determine whether more or less cooling fluid is needed for the cutting rotor based on the temperature proximate the one or more cutting bits.

15 Claims, 8 Drawing Sheets

TEMPERATURE CONTROLLED ROTOR SPRAY BAR

TECHNICAL FIELD

The present disclosure generally relates to a milling machine. More particularly, the present disclosure relates to temperature control of a rotor spray system.

BACKGROUND

Milling machines, such as a cold planers are powered machines used to remove at least part of a surface of a paved area such as a road, bridge, or parking lot. Typically, cold planers include a frame, a power source, a milling assembly positioned below the frame, and a conveyor system. The milling assembly includes a cutting rotor having numerous cutting bits disposed thereon. As the cutting rotor rotates, its cutting bits engage the hardened asphalt, concrete, or other materials of an existing surface of a paved area, thereby removing layers of these existing structures.

Some milling machines can include spray systems that include a spray bar with a plurality of spray nozzles. The spray systems can spray cooling fluid onto the cutting rotor or into the cutting rotor drum housing, as well as onto the conveyor belt system or into the dust ventilation. If the cutting bits become too hot, the heat can reduce the life of the cutting bits. However, if the cutting bits are already cooled, cooling fluid can be wasted if it is unnecessarily sprayed in excess quantities.

CN 110385469 discusses a temperature measuring milling cutter and a controller to alert the operator in case the temperature of the cutter is not in a pre-set range.

SUMMARY

In one example according to this disclosure, a milling machine can include a frame; a cutting rotor attached to the frame, the cutting rotor including a plurality of cutting bits positioned along a length of the cutting rotor; a plurality of temperature sensors positioned to determine a temperature proximate one or more of the plurality of cutting bits; a spray system coupled to the frame and including a spray bar having a plurality of nozzles configured to spray a cooling fluid on the cutting rotor; and a controller to receive the temperatures of the one or more cutting bits, the controller configured to determine whether more or less cooling fluid is needed for the cutting rotor based on the temperature proximate the one or more cutting bits.

In one example according to this disclosure, a cooling system for a milling machine can include a spray bar having a plurality of nozzles to deliver a cooling fluid to a cutting rotor; a plurality of temperature sensors positioned to detect a temperature proximate a plurality of cutting bits on the cutting rotor; and a controller configured to receive the temperatures of the plurality of cutting bits, the controller configured to determine whether more or less cooling fluid is needed for the cutting rotor based on the based on the temperatures of the plurality of cutting bits.

In one example, a method of controlling a cooling fluid flow in a spray bar can include detecting a temperature proximate a plurality of cutting bits across a width of a cutting rotor; and determining whether more or less cooling fluid is needed for the cutting rotor based on the detected temperatures of the plurality of cutting bits.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
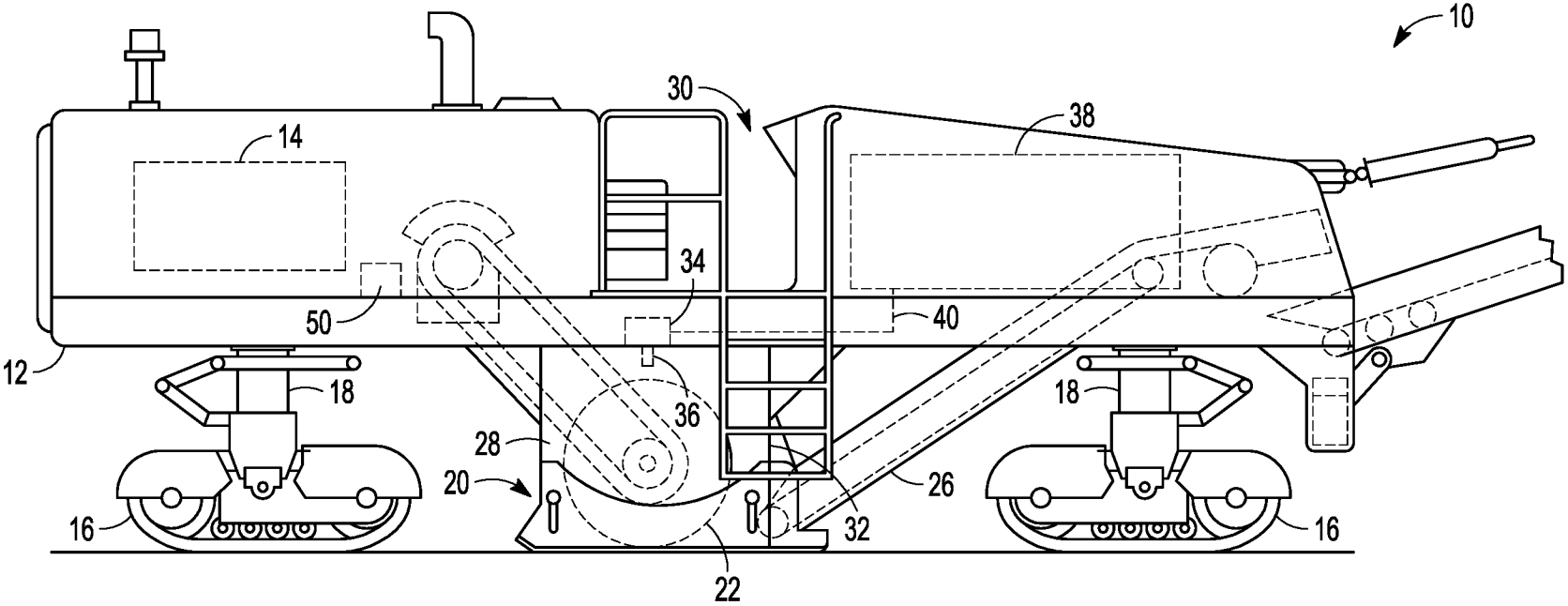
FIG. 1 shows a side view of a cold planer, in accordance with one embodiment.

FIG. 1 shows a side view of a milling machine, such as a cold planer 10, in accordance with one embodiment. The cold planer 10 can include a frame 12 and a power source 14 connected to the frame 12. The power source 14 can be provided in any number of different forms including, but not limited to, Otto and Diesel cycle internal combustion engines, electric motors, hybrid engines and the like. The frame 12 is supported by transportation devices 16 via lifting columns 18. The transportation devices 16 may be any kind of ground-engaging device that allows to move the cold planer 10 in a forward direction over a ground surface, for example a paved road or a ground already processed by the cold planer 10. For example, in the shown embodiment, the transportation devices 16 are configured as track assemblies. The lifting columns 18 are configured to raise and lower the frame 12 relative to the transportation devices and the ground.

The cold planer 10 further includes a milling assembly 20 connected to the frame 12. The milling assembly 20 includes a drum housing 28 holding a rotatable cutting rotor 22 operatively connected to the power source 14. The cutting rotor 22 can be rotated about a drum axis extending in a direction perpendicular to the frame axis. As the rotatable cutting rotor 22 spins about its drum axis, cutting bits on the cutting rotor 22 can engage hardened materials, such as, for example, asphalt and concrete, of existing roadways, bridges, parking lots and the like. As the cutting bits engage such hardened materials, the cutting bits remove layers of these hardened materials. The spinning action of the cutting rotor 22 and its cutting bits then transfers the hardened materials to a first stage conveyor 26 via a discharge port 32 on the drum housing 28. The first stage conveyor 26 can be coupled to the frame 12 and located at or near the discharge port 32 of the drum housing 28.

The cold planer 10 further includes an operator station or platform 30 including an operator interface for inputting commands to a control system for controlling the cold planer 10, and for outputting information related to an operation of the cold planer 10. A controller 50 can be provided for electrically controlling various aspects of the cold planer 10. For example, the controller 50 can send and receive signals from various components of the cold planer 10 during the operation of the cold planer 10.

The cold planer 10 can include a spray system coupled to the frame 12 and including a tank 38 and a fluid line 40 which delivers a cooling fluid from the tank 38 to a spray bar 34 having a plurality of nozzles 36. The spray system can spray water or other fluid onto the cutting rotor 22 or onto the material cut by the cutting rotor 22.

Figure 2:
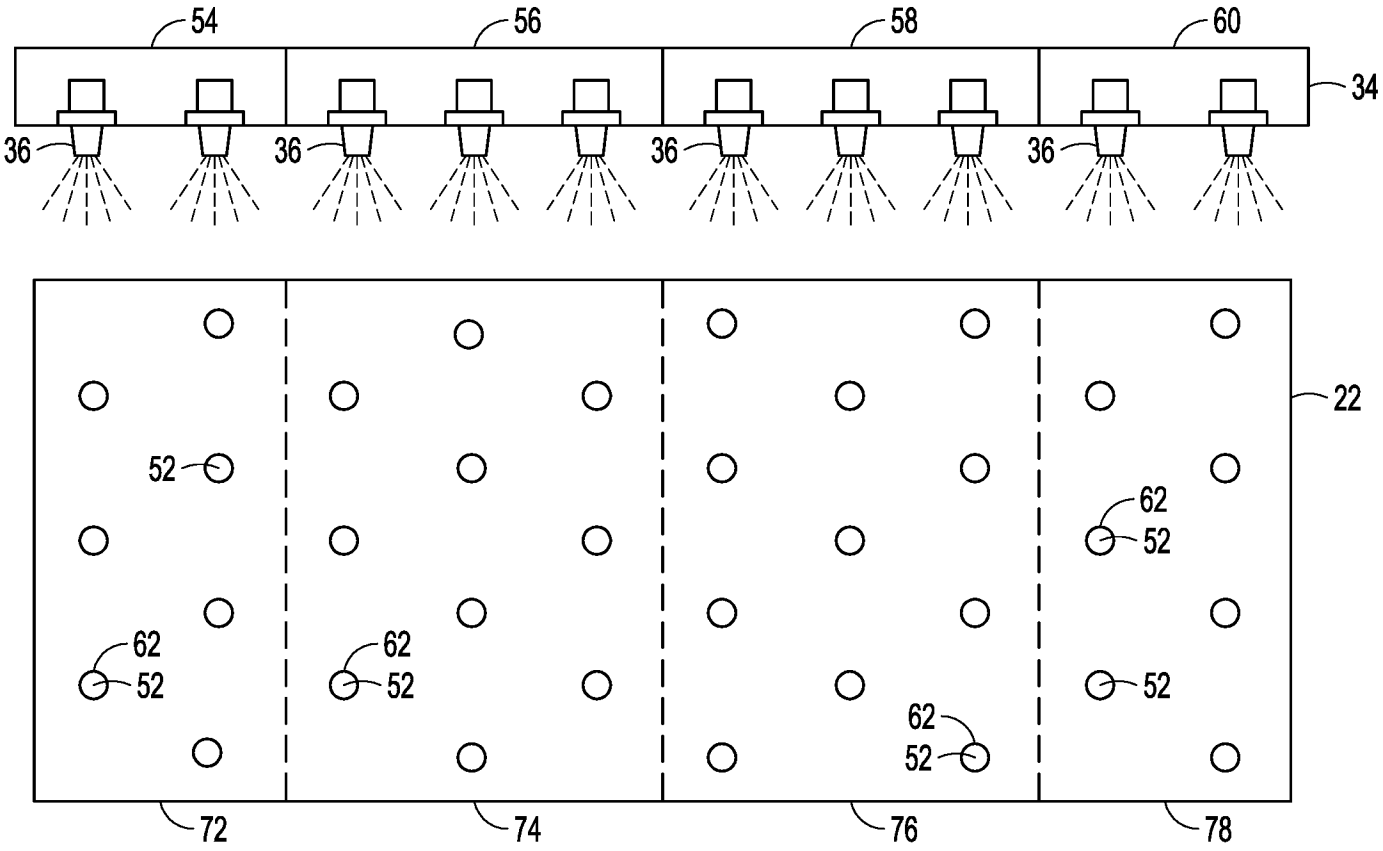
FIG. 2 shows a front view of a cutting rotor and a spray bar, in accordance with one embodiment.

FIG. 2 shows front view of the cutting rotor 22 and the spray bar 34, in accordance with one embodiment. In one example, the spray bar 34 can be positioned above the housing 28. The cooling fluid enters the spray bar 34 and then can be sprayed into the housing 28 by the plurality of nozzles 36 which can extend through the top surface of the drum housing 28. The nozzles 36 can be configured to eject and spray the cooling fluid onto the cutting rotor 22 or into the mixture of the surface that is cut up by the cutting rotor 22. For example, a reclaimer can often require a certain moisture level for the reclaimed material laid down and the spray bar 34 can deliver the proper amount of liquid to the mixture.

Here, the cutting rotor 22 is shown including a plurality of cutting bits 52 positioned along a length and circumference of the cutting rotor 22. As the cutting bits 52 on cutting rotor 22 cut, the cutting bits 52 become hot, and that heat can reduce the life of the cutting bits 52. Accordingly, the cold planer 10 includes the spray system including the spray bar 34 that helps keep the cutting bits 52 cool, while at the same time also aids in lubrication for better cutting bit rotation as well as reduces milling dust in the drum housing 28. In present milling machines, the operator cannot determine if the cutting bits are cooled to an appropriate temperature to optimize the cutting bit wear life while at the same time optimizing consumption of the cooling fluid.

Accordingly, the present system includes a plurality of temperature sensors 62 positioned to determine a temperature proximate one or more of the plurality of cutting bits 52. The temperature proximate the cutting bits 52 can be determined by either direct measurement or indirect measurement of the temperature at or near the cutting bit 52. For example, a plurality of the sensors 62 can be spaced along the length of the cutting rotor 22 and used for selected cutting bits 52 that represent a selected sample size depending on the size of the cutting rotor. The sensors 62 can be directly placed on the cutting bits 52 or be located on the cutting bit tool holders or in the block holding the tool holders. As used herein, the temperature proximate the cutting bits means the direct temperature of the cutting bits or the temperature adjacent to or near to the cutting bits.

Referring again to FIG. 1, the present system further includes the controller 50 which receives the temperatures of the one or more cutting bits 52 from the sensors 62. The controller 50 includes information regarding the location of each of the sensors 62 and can determine from the location information and the temperature received whether more or less cooling fluid is needed at various locations for the cutting rotor 22 based on the temperature proximate the one or more cutting bits 52.

In one example, the controller 50 can be configured to automatically control the cooling fluid flow from the spray bar 34 based on the temperatures of the one or more cutting bits 52. In another example, the controller 50 can be configured to send a notification to a machine operator to adjust the cooling fluid flow based on the temperatures of the one or more cutting bits 52.

In one example, the cutting rotor 22 can be divided into sections, such as a cutting rotor zone 72, a cutting rotor zone 74, a cutting rotor zone 76, and a cutting rotor zone 78. Again, more or fewer cutting rotor zones can be utilized depending on the length of the cutting rotor. Thus, the plurality of temperature sensors 62 can be associated with a selected plurality of the cutting bits 52, which can be located in various cutting zones along the length of the cutting rotor 22, and the controller can be configured to determine a temperature of various cutting zones 72, 72, 76, 78 of the cutting rotor 22 based on the temperature information received from the plurality of temperature sensors 62.

Likewise, the spray bar 34 can include a plurality of separate spray zones 54, 56, 58, and 60 located along a length of the spray bar 34. The cooling fluid flow from each of the nozzles 36 of each zone 54, 56, 58, 60 can be separately controllable by the controller 50 such that different rates of cooling fluid can be emitted from each zone 54, 56, 58, 60 independently. Thus, if the cutting rotor zone 76 is determined by the controller 50 to be too hot and in need of more cooling, the corresponding spray zone 58 of the spray bar 34 can be configured to deliver an increased rate of cooling fluid, as needed. The control system can have constant feedback so the controller 50 can determine if the different cutting rotor zones 72, 74, 76, 78 are in need of more or less cooling fluid, and the controller 50 can command the spray bar 34 to deliver cooling fluid as need and where needed.

Thus, since the controller 50 includes information regarding the location of each of the one or more cutting bits 52 and sensors 62, the controller 50 knows where cooling is needed and can determine from the location of each of the one or more cutting bits 52 and sensors 62 and the temperature proximate each of the one or more cutting bits 52 which spray zone 54, 56, 58, 60 needs to deliver more or less cooling fluid to a given cutting rotor zone 72, 74, 76, 78. Again, the spray bar 34 and the cutting rotor 22 can be divided into any number of useful spray zones.

Thus, the present system can provide more/less cooling fluid to a particular cutting rotor section or zone. This can effectively cool the cutting bits in those sections to an optimal temperature for reduced wear, without the use of excess water, which can be problematic for jobsite conditions as well as lead to more frequent stops to refill the machine water tank.

Figure 3:
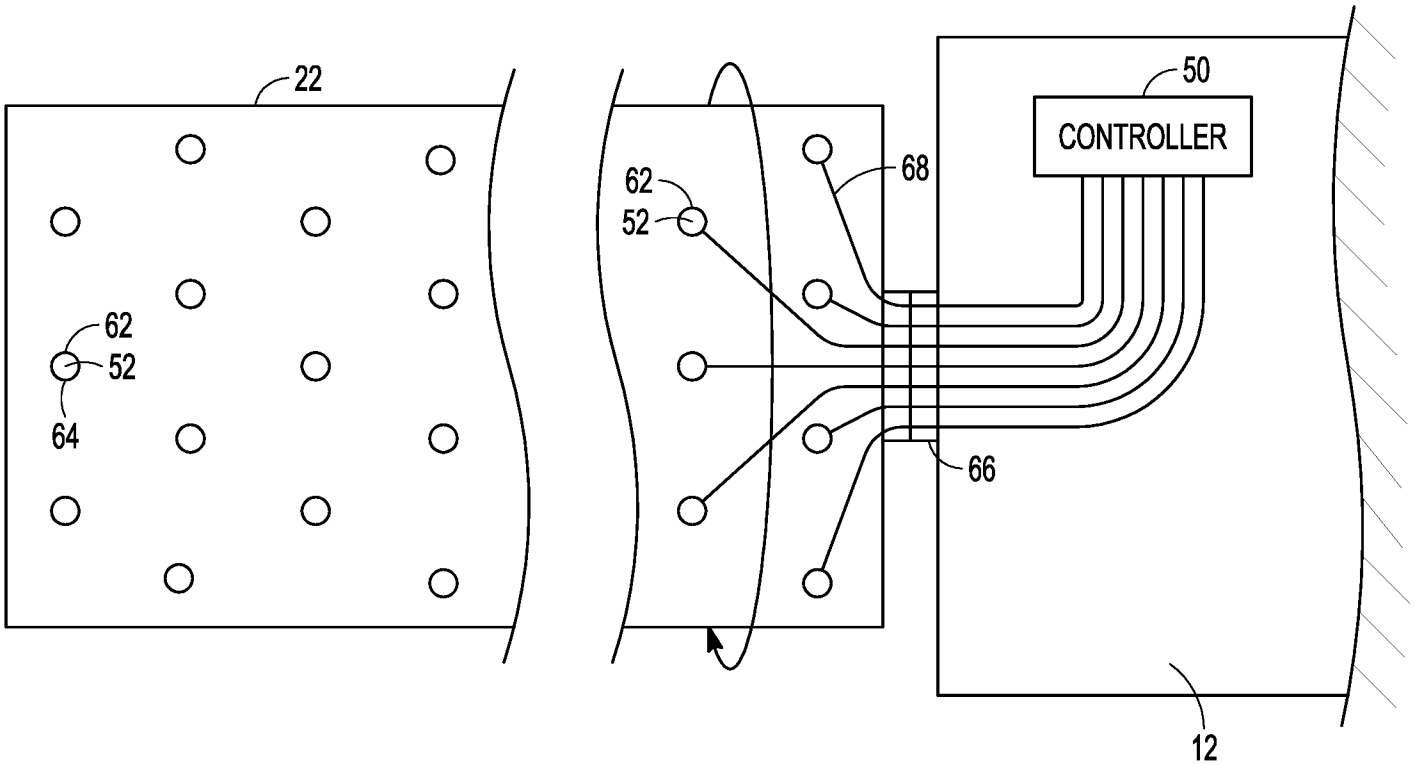
FIG. 3 shows a front view of the cutting rotor, in accordance with one embodiment.

The temperature sensors 62 of the present system can be any of a variety of temperature sensors. For example, FIG. 3 shows a front view of the cutting rotor 22, in accordance with one embodiment.

In this example, the temperature sensors 62 can include a plurality of contact sensors 64, such as RTD (Resistance Temperature Detectors) sensors or thermocouples, which can be mechanically fastened to the cutting rotor 22 in a way that determines a temperature proximate the cutting bits 52. For example, the contact sensors 64 can be located on the cutting bits 52, or on the toolholders of the cutting bits, or on the cutting rotor body directly adjacent the cutting bit. In this example the contact sensors 64 can be connected by electrical connector wires 68 and pass through an electrical slip ring 66 to reach the controller 50.

Figure 4:
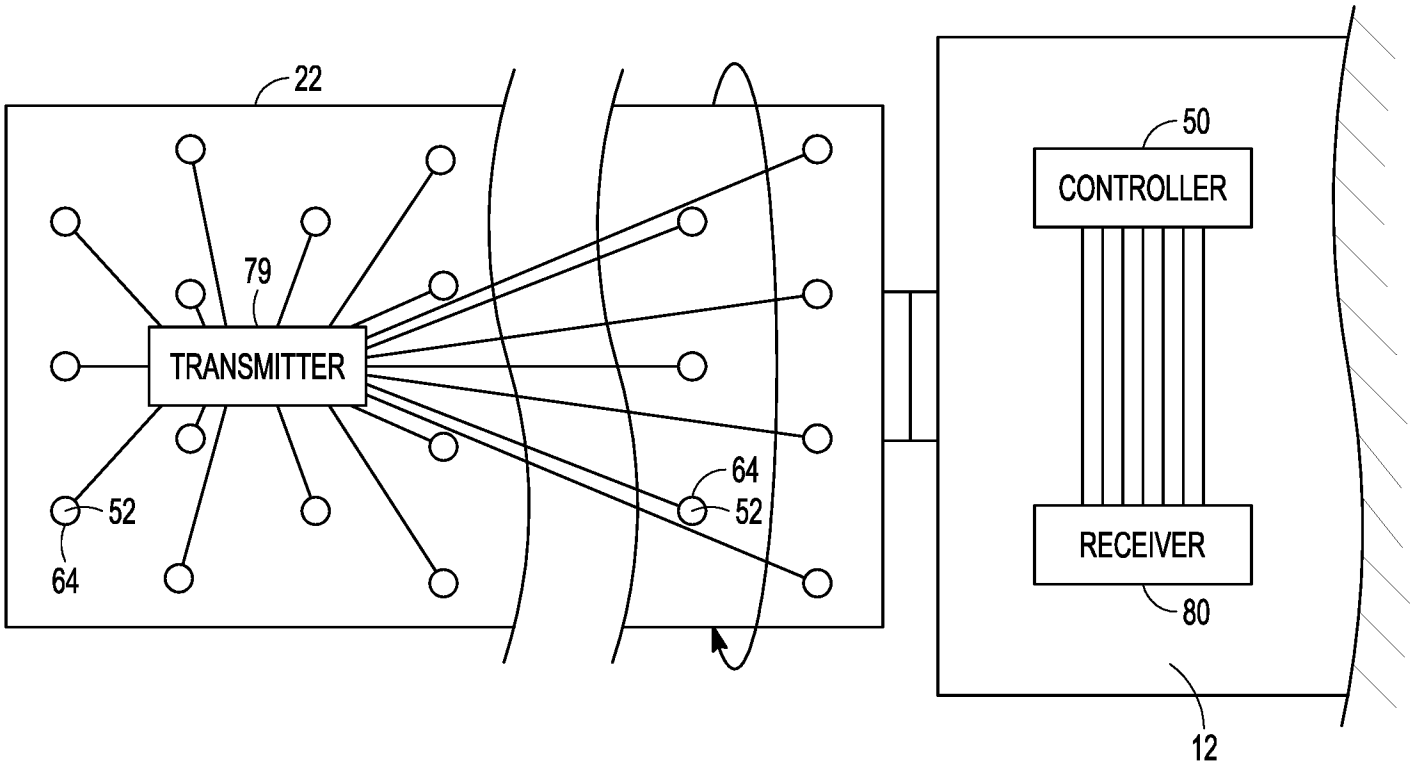
FIG. 4 shows a front view of the cutting rotor, in accordance with one embodiment.

FIG. 4 shows a front view of the cutting rotor 22, in accordance with one embodiment. Here, the plurality of contact sensors 64 can be mechanically fastened to the cutting rotor 22 in a way that determines a temperature proximate the cutting bits 52. For example, the contact sensors 64 can be located on the cutting bits 52, or on the toolholders of the cutting bits, or on the cutting rotor body directly adjacent the cutting bit. The sensors 64 can be coupled to a transmitter 79 located within the cutting rotor 22. The transmitter 79 can deliver the temperature information to a receiver 80 which can deliver the temperature information to the controller 50. Thus, using the wireless transmitter 79 attached to the cutting rotor 22 eliminates the need for a slip ring at the rotating joint.

Figure 5:
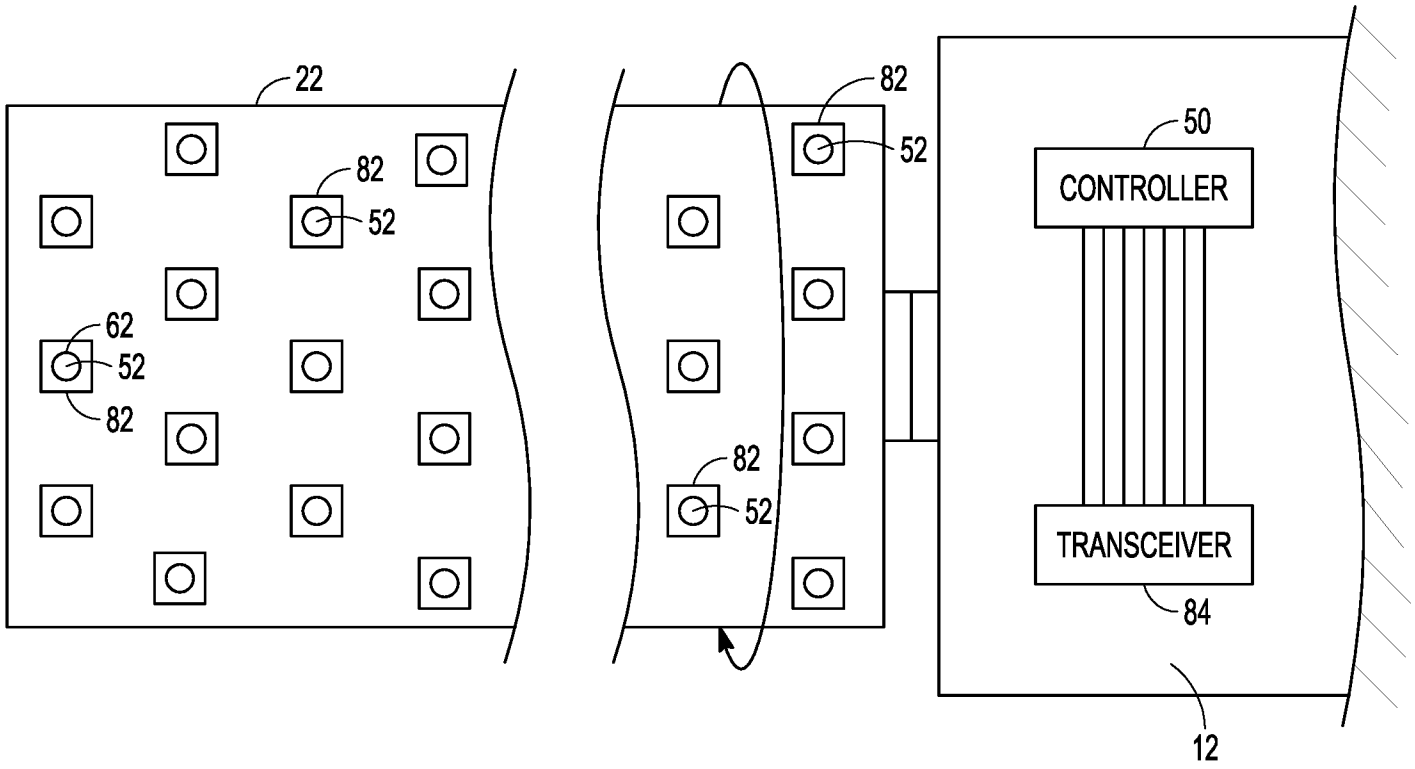
FIG. 5 shows a front view of the cutting rotor, in accordance with one embodiment.

FIG. 5 shows a front view of the cutting rotor 22, in accordance with one embodiment. In this example, the sensors 62 can include a plurality of wireless, passive SAW (surface acoustic wave) sensors 82 adhered to a plurality of the cutting bits 52, or toolholders, or the cutting rotor body directly adjacent the cutting bits 52 so as to determine the cutting bit temperatures and transmit the temperature information to an RF transceiver 84 mounted near the cutting rotor 22. The transceiver 84 then relays the information to the controller 50.

Figure 6:
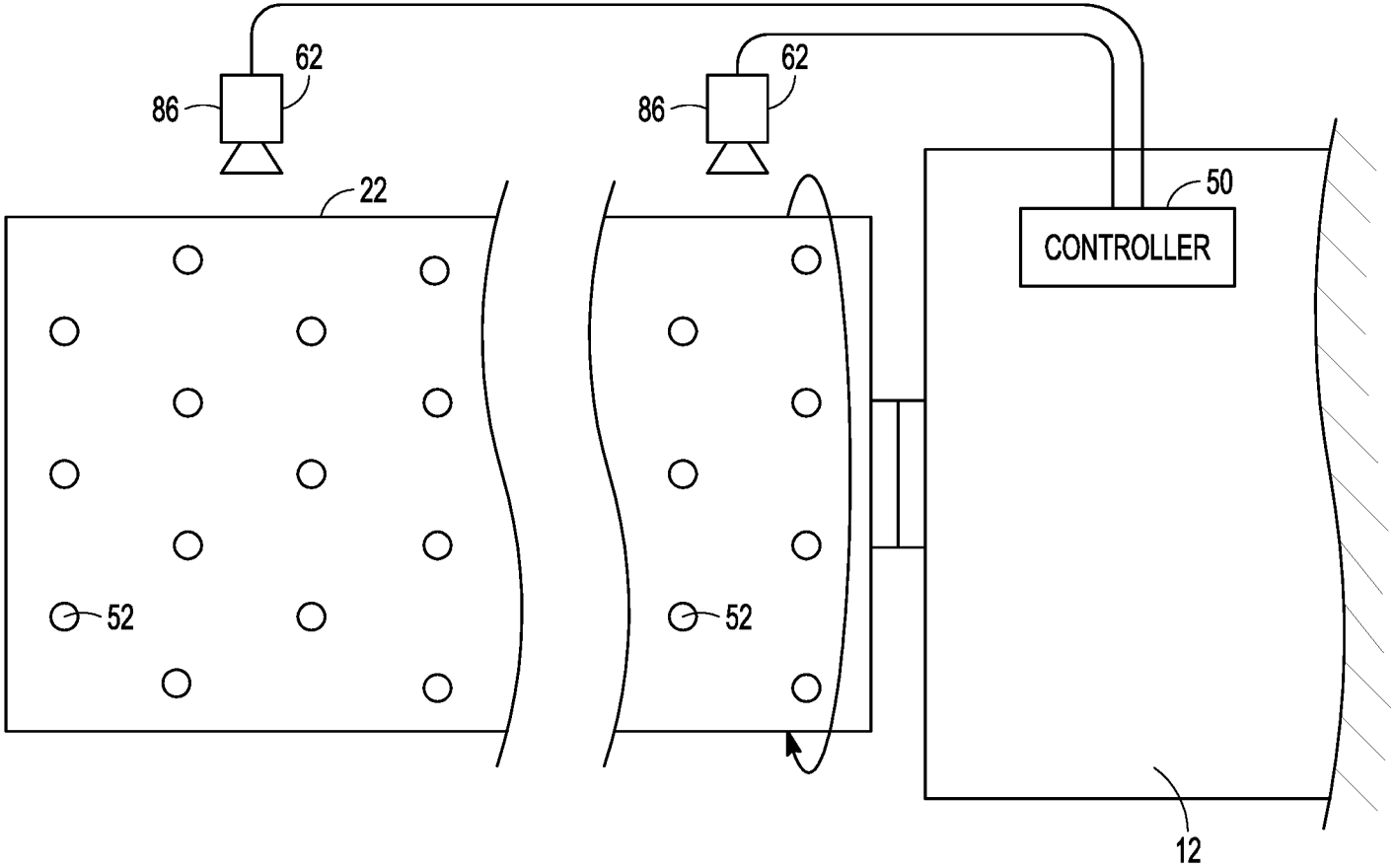
FIG. 6 shows a front view of the cutting rotor, in accordance with one embodiment.
Figure 7:
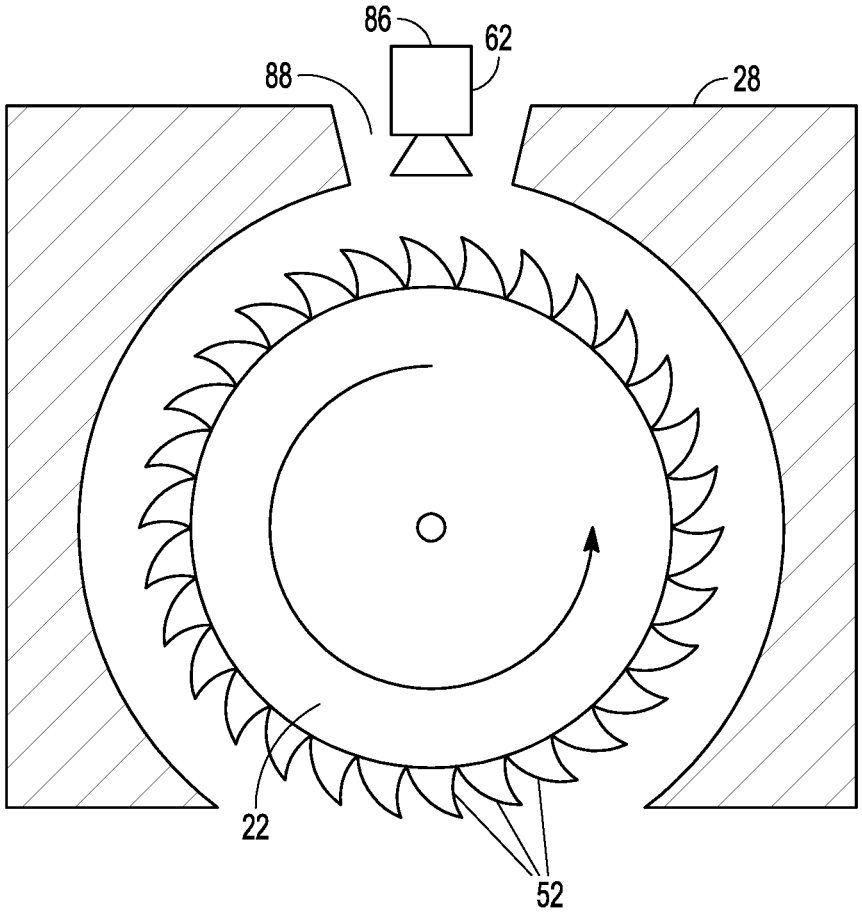
FIG. 7 shows a side view of the cutting rotor of FIG. 6.

FIG. 6 shows a front view of the cutting rotor 22, in accordance with one embodiment; and FIG. 7 shows a side view of the cutting rotor 22 of FIG. 6.

In this embodiment, the sensors 62 can include one or more thermal scanners or thermal cameras 86 mounted so as to view the cutting rotor 22 inside the drum housing 28. The thermal cameras 86 are directed to measure the cutting bit temperatures as the cutting rotor 22 rotates. For example, a window 88 can be formed at a wall of the drum chamber allowing the thermal cameras 86 to view the cutting rotor 22. The information from the thermal cameras 86 can be sent to the controller 50 and the controller 50 can determine from the thermal information which parts or sections of the cutting rotor 22 need more or less cooling.

Figure 8:
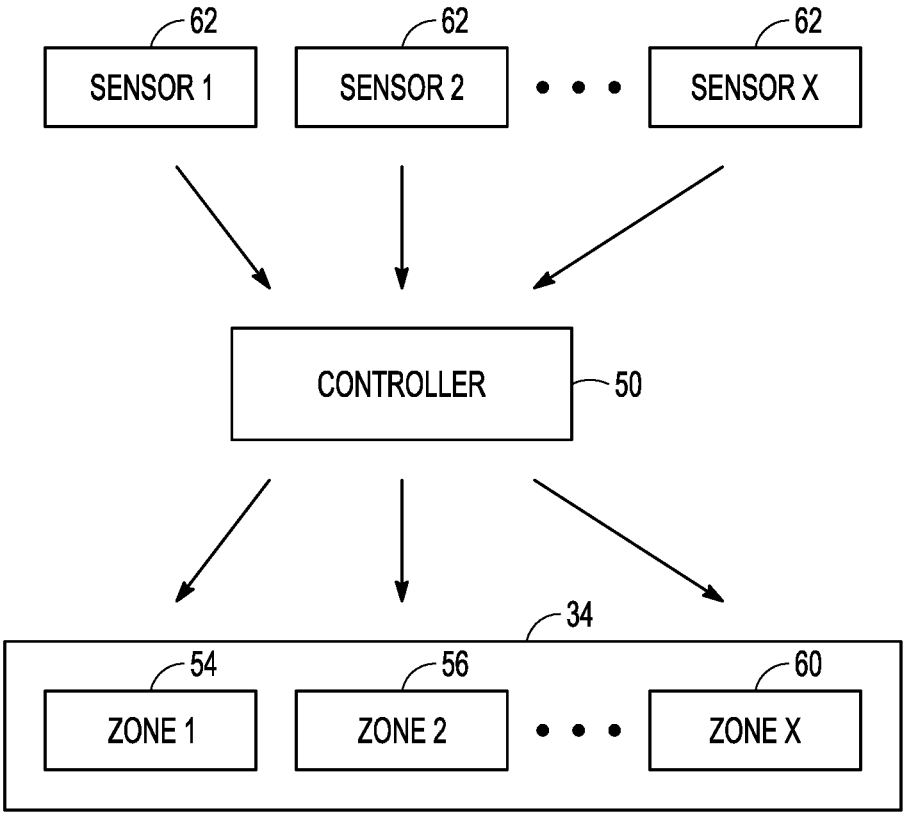
FIG. 8 shows a cooling control system, in accordance with one embodiment.

FIG. 8 shows a cooling control system, in accordance with one embodiment. The cooling control system can include the spray bar 34 which can be divided into a plurality of spray zones 54, 56 . . . X. The system further includes the sensors 62 that can be positioned and located so as to measure the cutting bits temperatures along various cutting rotor zones and denoted as sensor 1, sensor 2 . . . sensor X. The controller 50 receives the temperatures of the plurality of cutting bits from the sensors 62. The controller knows the location of each sensor 62 and can be configured to determine whether more or less cooling fluid is needed for the cutting rotor 22 based on the temperatures of the plurality of cutting bits.

Again, the controller 50 can be configured to automatically control the cooling fluid flow from the spray bar 34 based on the temperatures of the plurality of cutting bits, or the controller 50 can be configured to send a notification to a machine operator to adjust the cooling fluid flow.

As discussed above, the spray bar 34 can include the plurality of separate spray zones 54, 56 . . . X located along a length of the spray bar 34. Each spray zone can be separately controllable such that different rates of cooling fluid can be emitted from each spray zone independently depending on the temperatures from the various sensors 62 sent to the controller 50.

INDUSTRIAL APPLICABILITY

The present system can be applicable to any work machine that uses a spray bar, such as a cold planer or a reclaimer, or an asphalt compactor, for example. The system can be applicable to any work machine spray system where the nozzles spray a cooling fluid onto a cutting rotor or a compaction drum.

Figure 9:
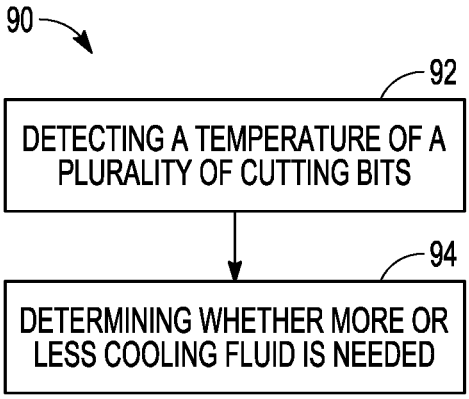
FIG. 9 shows a flow chart of a method of controlling a cooling fluid flow in a spray bar, in accordance with one embodiment.

FIG. 9 shows a method (90) of controlling a cooling fluid flow in a spray bar, in accordance with one embodiment. The method (90) can include detecting a temperature (92) of a plurality of cutting bits across a width of a cutting rotor; and determining whether more or less cooling fluid is needed for the cutting rotor (94) based on the detected temperatures of the plurality of cutting bits.

The cooling fluid can be delivered from a spray bar and the spray bar can include a plurality of separate spray zones located along a length of the spray bar. The controller can include information regarding a location of each of the plurality of cutting bits and can determine from the location and the temperature proximate each of the plurality of cutting bits which spray zone needs more or less cooling fluid.

The controller can be configured to automatically control the cooling fluid flow from the spray bar based on the temperatures of the one or more cutting bits, or the operator can be alerted that one or more sections along the length of the cutting rotor need more or less cooling fluid, as determined by the temperature.

Accordingly, the present system provides a closed loop control system that can be used to measure the temperature proximate the cutting bits under operation, and then alert the operator and/or automatically adjust the spray system to provide more/less cooling fluid to a particular section or zone of the cutting rotor. This can effectively cool the cutting bits in those sections to an optimal temperature for reduced wear, without the use of excess water, which can be problematic for jobsite conditions as well as lead to more frequent stops to refill the machine water tank.

The above detailed description is intended to be illustrative, and not restrictive. The scope of the disclosure should, therefore, be determined with references to the appended claims, along with the full scope of equivalents to which such claims are entitled.

What is claimed is:

1. A milling machine comprising:

a frame;

a cutting rotor attached to the frame, the cutting rotor including a plurality of cutting bits positioned along a length of the cutting rotor;

a plurality of temperature sensors positioned to determine a temperature proximate one or more of the plurality of cutting bits, the positions of the plurality of temperature sensors defining a plurality of separate cutting zones along the length of the cutting rotor;

a spray system coupled to the frame and including a spray bar having a plurality of nozzles configured to spray a cooling fluid on the cutting rotor, wherein the spray bar includes a plurality of separate spray zones located along a length of the spray bar wherein the separate spray zones are independently operated such that there is a separately controlled rate of cooling fluid flow for each separate spray zone; and a controller to receive the temperatures proximate the one or more cutting bits, the controller configured to determine whether more or less cooling fluid is needed for the cutting rotor based on the temperature proximate the one or more cutting bits, wherein the controller includes information regarding a location of each of the one or more cutting bits and can determine from the location of each of the one or more cutting bits and the temperature proximate each of the one or more cutting bits which of the cutting zones needs more or less cooling and which of the spray zones needs to deliver more or less cooling fluid and the controller separately controls the rates of cooling fluid for each spray zone in view of any varying temperatures.

2. The milling machine of claim 1, wherein the controller is configured to automatically control a cooling fluid flow from the spray bar based on the temperatures proximate the one or more cutting bits.

3. The milling machine of claim 1, wherein the controller is configured to send a notification to a machine operator to adjust a cooling fluid flow based on the temperatures proximate the one or more cutting bits.

4. The milling machine of claim 1, wherein the temperature sensors include contact sensors.

5. The milling machine of claim 1, wherein the temperature sensors include SAW sensors.

6. The milling machine of claim 1, wherein the temperature sensors include thermal cameras.

7. A cooling system for a milling machine, the cooling system comprising:

a spray bar having a plurality of nozzles to deliver a cooling fluid to a cutting rotor, wherein the spray bar includes a plurality of separate spray zones located along a length of the spray bar wherein the separate spray zones are independently operated such that there is a separately controlled rate of cooling fluid flow for each separate spray zone;

a plurality of temperature sensors each positioned to detect a temperature proximate a plurality of cutting bits on the cutting rotor, the positions of the plurality of temperature sensors defining a plurality of separate cutting zones along a length of the cutting rotor; and a controller configured to receive the temperatures proximate the plurality of cutting bits, the controller configured to determine whether more or less cooling fluid is needed for the cutting rotor based on the temperatures proximate the plurality of cutting bits, wherein the controller includes information regarding a location of each of the one or more cutting bits and can determine from the location of each of the one or more cutting bits and the temperature proximate each of the one or more cutting bits which of the cutting zones needs more or less cooling and which of the spray zones needs to deliver more or less cooling fluid and the controller separately controls the rates of cooling fluid for each spray zone in view of any varying temperatures.

8. The cooling system of claim 7, wherein the controller is configured to automatically control a cooling fluid flow from the spray bar based on the temperatures proximate the plurality of cutting bits.

9. The cooling system of claim 7, wherein the controller is configured to send a notification to a machine operator to adjust a cooling fluid flow.

10. The cooling system of claim 7, wherein the temperature sensors include contact sensors.

11. The cooling system of claim 7, wherein the temperature sensors include SAW sensors.

12. The cooling system of claim 7, wherein the temperature sensors include thermal cameras.

13. A method of controlling a cooling fluid flow in a spray bar, the method comprising:

detecting a temperature proximate a plurality of cutting bits across a width of a cutting rotor, the cutting bits having positions defining a plurality of separate cutting zones along a length of the cutting rotor;

determining whether more or less cooling fluid is needed for the cutting rotor based on the detected temperatures proximate the plurality of cutting bits; and delivering cooling fluid from a spray bar, the spray bar having a plurality of nozzles to deliver a cooling fluid to a cutting rotor, wherein the spray bar includes a plurality of separate spray zones located along a length of the spray bar, wherein the separate spray zones are independently operated such that there is a separately controlled rate of cooling fluid flow for each separate spray zone;

wherein determining whether more or less cooling fluid is needed includes determining from the location of each of the one or more cutting bits and the temperature proximate each of the one or more cutting bits which of the cutting zones needs more or less cooling and which of the spray zones needs to deliver more or less cooling fluid and the controller separately controls the rates of cooling fluid for each spray zone in view of any varying temperatures.

14. The method of claim 13, wherein a controller includes information regarding a location of each of the plurality of cutting bits and can determine from the location and the temperature proximate each of the plurality of cutting bits which spray zone needs to deliver more or less cooling fluid.

15. The method of claim 14, wherein the controller is configured to automatically control the cooling fluid flow from the spray bar based on the temperatures proximate the one or more cutting bits.

* * * * *